US011702250B2

(12) United States Patent
Lo Piccolo et al.

(10) Patent No.: US 11,702,250 B2
(45) Date of Patent: Jul. 18, 2023

(54) METAL CLOSURE FOR A CONTAINER, METHOD FOR MAKING THE SAME AND METHOD FOR CAPPING A CONTAINER WITH THE SAME

(71) Applicant: PELLICONI & C. S.p.A., Ozzano dell'Emilia (IT)

(72) Inventors: Antonino Lo Piccolo, Battipaglia (IT); Doriano Naldi, Ozzano dell'Emilia (IT)

(73) Assignee: PELLICONI & C. S.P.A., Ozzano dell'Emilia (IT)

( * ) Notice: Subject to any disclaimer, the term of this patent is extended or adjusted under 35 U.S.C. 154(b) by 447 days.

(21) Appl. No.: 16/614,662

(22) PCT Filed: Jun. 6, 2018

(86) PCT No.: PCT/IB2018/054032

§ 371 (c)(1),
(2) Date: Nov. 18, 2019

(87) PCT Pub. No.: WO2018/224968

PCT Pub. Date: Dec. 13, 2018

(65) Prior Publication Data

US 2020/0180820 A1 Jun. 11, 2020

(30) Foreign Application Priority Data

Jun. 7, 2017 (IT) ..... 102017000062510

(51) Int. Cl.
*B65D 41/12* (2006.01)
*B21D 51/46* (2006.01)
*B21D 51/48* (2006.01)

(52) U.S. Cl.
CPC ..... *B65D 41/12* (2013.01); *B21D 51/46* (2013.01); *B21D 51/48* (2013.01); *B65D 2251/20* (2013.01)

(58) Field of Classification Search
CPC .... B65D 41/12; B65D 2251/20; B21D 51/46; B21D 51/48
(Continued)

(56) References Cited

U.S. PATENT DOCUMENTS 1,257,710 A * 2/1918 Januchowsky ..... B65D 41/12 215/328
1,476,472 A * 12/1923 Smith ..... B65D 41/12 215/302
(Continued)

FOREIGN PATENT DOCUMENTS

EP 1238917 A1 9/2002
EP 2746184 A1 6/2014
(Continued)

OTHER PUBLICATIONS

European Office Action dated Jan. 20, 2021 from counterpart European Patent Application No. 18732912.3.
(Continued)

*Primary Examiner* — J. Gregory Pickett
*Assistant Examiner* — Niki M Eloshway
(74) *Attorney, Agent, or Firm* — Shuttleworth & Ingersoll, PLC; Timothy J. Klima

(57) ABSTRACT

A metal closure for containers comprising a capsule designed to be applied to an opening of a container and including a circular part from which extends a perimeter edge. The perimeter of the edge has a rounding or folding obtained by curling and has a series of deformations made in a radial direction towards the centre of the capsule for forming the seal.

11 Claims, 4 Drawing Sheets

(58) Field of Classification Search
USPC ..... 215/328
See application file for complete search history.

(56) References Cited

U.S. PATENT DOCUMENTS

| | | | | |
|---|---|---|---|---|
| 2,063,454 | A | 12/1936 | McManus | |
| 3,147,875 | A * | 9/1964 | Rutledge, Sr. | B65D 41/12 215/328 |
| 3,198,369 | A * | 8/1965 | St Jacques | B65D 41/12 215/328 |
| 3,490,635 | A | 1/1970 | Wilson et al. | |
| 3,514,004 | A * | 5/1970 | Hammersmith | B65D 41/12 215/328 |
| 3,615,033 | A | 10/1971 | Podesta | |
| 2002/0125204 | A1* | 9/2002 | Ramsey | B65D 41/12 215/327 |
| 2016/0107802 | A1* | 4/2016 | Merino | B21D 51/48 413/8 |

FOREIGN PATENT DOCUMENTS

| | | | |
|---|---|---|---|
| FR | 2274515 | A1 | 1/1976 |
| GB | 809047 | A | 2/1959 |

OTHER PUBLICATIONS

International Search Report dated Oct. 23, 2018 from counterpart PCT App No. PCT/IB2018/054032.
Indian Office Action dated Sep. 27, 2021 from counterpart Indian Patent Application No. 201927047183.

* cited by examiner

METAL CLOSURE FOR A CONTAINER, METHOD FOR MAKING THE SAME AND METHOD FOR CAPPING A CONTAINER WITH THE SAME

This application is the National Phase of International Application PCT/162018/054032 filed Jun. 6, 2018 which designated the U.S.

This application claims priority to Italian Patent Application No. 102017000062510 filed Jun. 7, 2017, which application is incorporated by reference herein.

TECHNICAL FIELD

This invention relates to a method for making a cap.

This invention also relates to the production of a closing capsule for containers, particularly for bottles.

This invention also relates to the provision of means designed to actuate the method for making a cap.

BACKGROUND ART

The term crown cap universally defines the closing cap, normally made of metal, shaped in the form of a shell/capsule with a circular shape from the periphery of which extends a series of teeth uniformly distributed.

In effect, the shell has an upper face with an extension greater than that from which the crown of teeth extends, defining, in that way, an inner space which is designed to receive the neck of the container to be capped.

The upper face is flat or slightly convex towards the outside.

Patterns, colours and/or distinctive signs of the product contained in the coupled bottle are usually applied on the outer surface of the upper face.

A sealing gasket is positioned inside the shell at an inner surface of the upper face.

The method which is currently used for making a crown cap is as follows: many patterns are printed, or in another manner marked, on a sheet of material constituting the cap (steel) of suitable dimensions. Then by using punching presses the sheet is cut, producing the shell, separating it from the sheet and, at the same time, forming the crown of teeth. After applying the seals inside the capsules they are then introduced on the market.

This method is certainly advantageous, so much so that the diffusion of the crown caps is particularly widespread and their cost remains contained.

However, the drawbacks of the prior art consist of the fact that the particular morphology and the techniques to obtain the conventional crown cap require the use of a material of adequate thickness, not less than 0.16 mm. The use of lower thicknesses would limit in a problematic manner the pressure to which the cap would be capable of withstanding.

On the other hand, the provision of higher pressures of the product introduced in the container closed with the crown cap, usually a carbonated beverage, would require the use of greater thicknesses of the material, complicating the operating steps for making the cap.

The finishing of the edge of the crown of teeth also has a drawback, often being sharp, with the risk of injuries and cuts for the person handling the container closed with the cap.

Aim of the Invention

The aim of this invention is to overcome the above-mentioned drawbacks proposing a metal closure for containers which can be produced with materials of thickness less than 0.16 mm, in particular in the range of 0.12 to 0.16 mm.

Another aim of the invention is to propose a cap, as mentioned above, which is capable of withstanding pressures usually planned for the crown caps currently used, or even greater.

A further aim of the invention to provide a cap as mentioned above which can, however, be opened like a traditional crown cap and which does not have the sharp edge which is typical of the crown caps conventionally used.

More specifically, the aim of this invention is to provide a method for making a cap which allows the above-mentioned aims to be achieved without making the relative production steps more complicated or costly and in fact facilitating the production and making it more economical.

A further aim of this invention is to propose a method for implementing the capping of a bottle using a cap made with the above-mentioned features.

A further aim of this invention is to provide a capsule, configuring the cap, made with the features mentioned in the above points.

A further aim of the invention is to provide means for implementing the method which allows the production of a cap allowing the above-mentioned aims to be achieved.

These aims are fully achieved by the method forming the object of this invention and as characterized in the appended claims.

BRIEF DESCRIPTION OF THE DRAWINGS

The invention can be better understood and implemented with reference to the accompanying drawings which illustrate non-limiting example embodiments, purely by way of example, and in which.

DETAILED DESCRIPTION OF PREFERRED EMBODIMENTS OF THE INVENTION

Figure 1A:
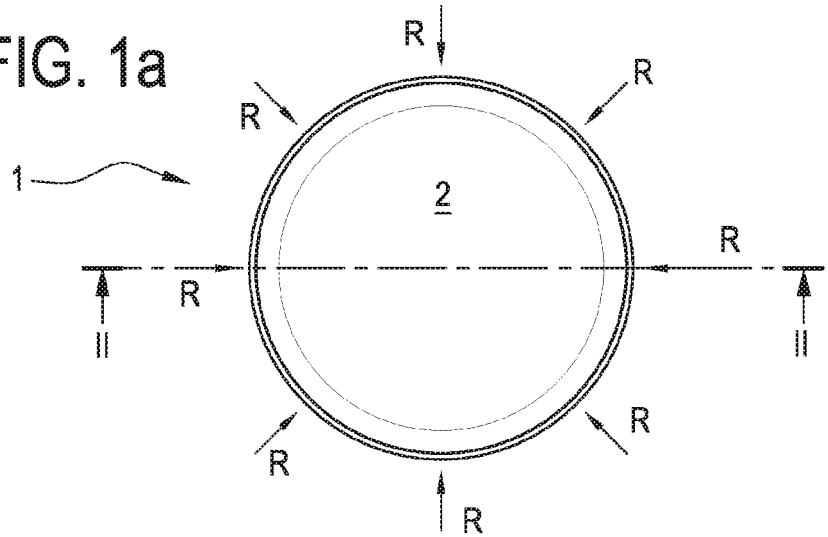
FIGS. 1*a* and 1*b* illustrate a cap according to the invention, ready to be applied to a bottle, respectively a top view and a section through the line II-II.
Figure 1B:
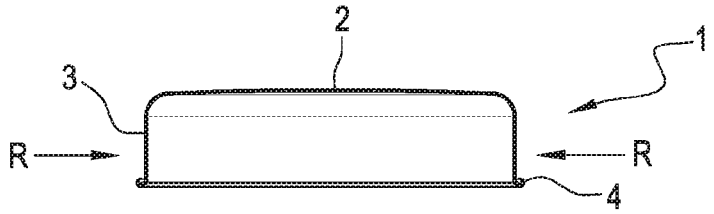

FIGS. 1 to 8 describes a metal closure for containers, in particular containers made of glass (but not necessarily), for example, but not exclusively, bottles.

According to a first aspect of the invention, the closure described here substantially constitutes a so-called cap 6 (FIG. 3), obtained from a sheet of metallic material (not illustrated), for example steel, as is usually used.

Patterns may be printed or marked on the sheet, even subsequently, which will then will constitute a personalising element 7.

According to the method, discs 8 are then obtained by cutting.

The closure, or cap, is then obtained from the disc 8, which substantially comprises a capsule 1, which defines the body of the metallic closure, designed to be applied to cover an opening 10 (FIGS. 2 and 3) of a container 11.

Reference is made below and in the drawings, for simplicity, to a bottle 11, but it is understood that the invention also applies to other types of containers, for example cans, designed to be sealed with a metal closure of the so-called cap type.

The capsule 1 (FIG. 7) comprises a circular part 2 from which extends a perimeter edge 3 which wraps circumferentially around the opening 10, so as to form the seal of the metallic closure relative to the bottle 11.

More in detail, the edge 3 extends in a direction at right angles or practically at right angles, to the circular part 2, defining, in that way, an inner space designed to receive the neck of the container to be capped.

The upper face of the circular part 2 is flat or slightly convex towards the outside.

Figure 8:
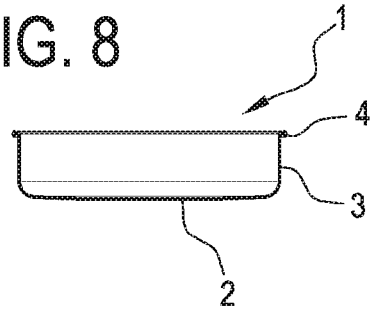

According to the invention, the perimeter of the edge 3 has a rounding or folding 4 (FIG. 8).

Preferably, the folding 4 is performed towards the outside of the capsule 1.

In other words, the folding is performed by bending the edge 3 towards the outside.

Again according to the invention, the rounding or folding is obtained by means of an action of folding 4 and extends, preferably, over 360° of the edge 3 of the metallic closure. As mentioned in the introduction, curling is an operation which, in the sector of containers, is carried out to stiffen the edge and allow, with a technique similar to seaming, the application of a lower base.

Curling is therefore, more generally, a process of cold plastic deforming, usually carried out with specifically designed machines.

With this shape, the cap is ready for use and is thus marketed.

Once applied on the opening 10 of the bottle 11, the edge 3 has a series of deformations 5 (FIG. 3), made in a radial direction R towards the centre of the capsule 1.

Preferably, the deformations 5 are obtained by radial pressures exerted in stretches (that is, in predetermined areas) along the entire circumference of the edge 3, as described in more detail below.

It should be noted that these deformations 5 do not touch the rounding or folding 4, that is, the areas of deformation do not touch the folding 4.

More specifically, the deformations 5 are made in the area of the edge 3 not touched by the rounding or folding 4.

Figure 10:
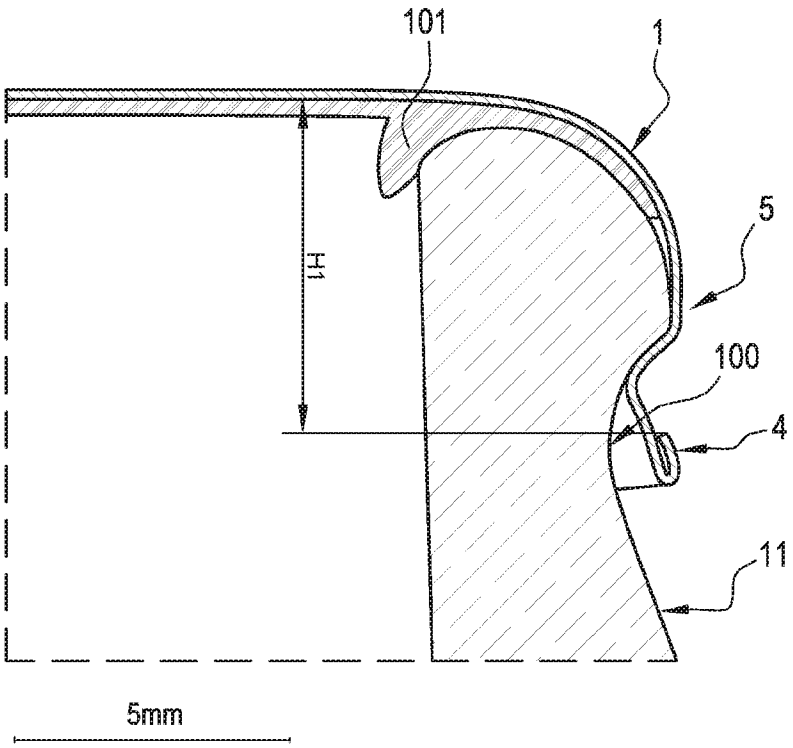
FIG. 10 illustrates a cross section of the cap according to this invention applied to the neck of a container (bottle), executed transversely in a region affected by the deformations.
Figure 9:
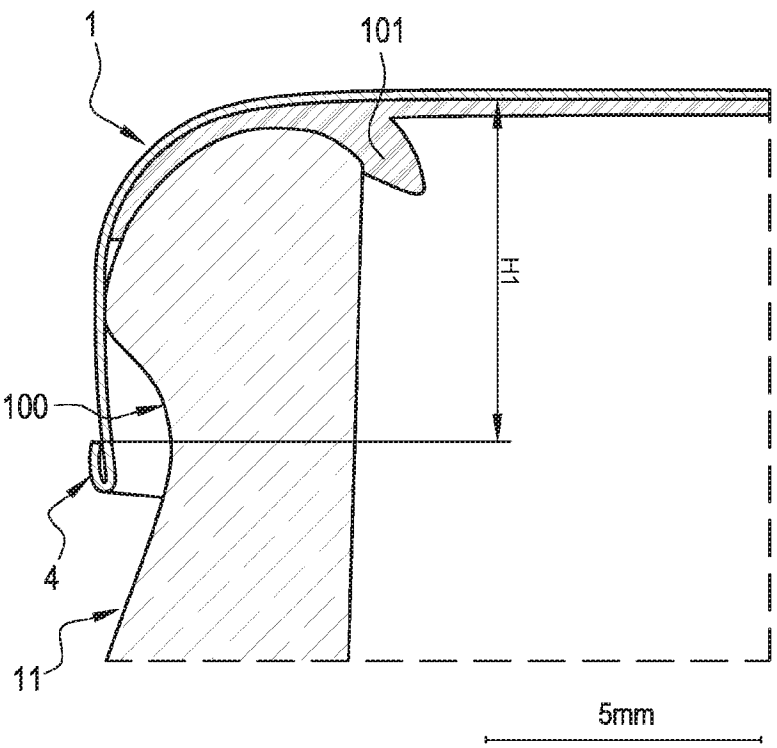
FIG. 9 illustrates a cross section of the cap according to this invention applied to the neck of a container (bottle), executed transversely in a region not affected by the deformations.

It should also be noted, as is evident from FIGS. 9 and 10, that the folding is, in use, arranged and positioned, relative to the base of the container, at an area 100 concave towards the outside.

It should be noted that, preferably, the distance between the start of the folding 4 and the bottom of the metal capsule 1, labelled H1, is greater than 4 mm.

It should be noted that, more preferably, the distance between the start of the folding 4 and the bottom of the metal capsule 1, labelled H1, is greater than 5 mm.

Still more preferably, the distance between the start of the folding 4 and the bottom of the metal capsule 1, labelled H1, is between 5 and 10 mm.

The deformations 5 are designed to apply a pressure below the swelling 12 of the opening 10 in order to apply a pulling action on the circular part 2 against the opening 10 and in this way make the seal.

It should be noted that the deformations 5 have the function of offering a leverage point for bottle openers, so as to allow the opening of the container. In order to obtain the seal, between the inner surface of the capsule 1 and the opening 10 there is a gasket 101 (illustrated in FIGS. 9 and 10), obtained according to known methods by applying a suitable material inside the capsule during its production, that is, before the sale and application on the bottle.

FIGS. 8 and 9 illustrate a seal, labelled 101, that is to say, a sealing element, positioned coupled to the capsule 1 (in particular coupled to the bottom of the inner surface of the capsule 1).

It should be noted that, preferably, as mentioned above, the deformations 5 are made in the area of the edge 3 not touched by the rounding or folding 4.

To improve the seal, during the radial deformation of the edge 3, the cap is kept pressed above against the neck of the bottle, compressing the seal which reacts elastically sealing the closure.

The number of deformation areas 5 in a radial fashion R is between 6 and 14, more preferably between 8 and 12, optimally equal to 10 (with reference, without limiting the scope of the invention, to a cap with a diameter of 26 mm).

More generally, there may be any number of deformation areas 5 in a radial fashion R.

It should be noted that the cap as described above may be made of a metallic material having a greatly reduced thickness, between 0.12 mm and 0.16 mm, given its construction shape.

The radial dimensions of the capsule, that is to say, of the cap, may be any.

On the other hand, with the crown caps currently constructed, shaped in the form of a shell/capsule with a circular shape from the periphery of which extends a series of corrugations which form uniformly distributed teeth, it is not possible to make thicknesses of less than 0.16 mm.

This feature makes it possible to obtain a substantial saving of material and thus reduce the costs.

It should be noted that, on the other hand, whilst keeping unchanged the thickness of the material used, for example steel, with the same thickness the cap made according to the method according to the invention will be able to withstand greater pressures of the contents of the bottle.

The cap made according to the invention opens like a conventional crown cap, with a bottle opener.

Another aspect of the invention covers a method for making the metallic closure, or cap, as described above.

More in detail, the method according to the invention comprises, basically, the following steps:

making a capsule 1, designed to defines the body of the metallic closure and designed to be applied to cover an opening 10 of a container or bottle 11.

The capsule obtained comprises a circular part 2 designed to rest on the opening 10, and a perimeter edge 3 which extends from the circular part 2. In this way, an inner space is defined which is designed to receive the neck of the bottle to be capped. Basically, the edge 3 must wrap circumferentially around the opening 10 of the bottle 11.

The method also comprises a step of making a rounding or folding 4 of the edge 3.

It should be noted that the rounding or folding 4 of the edge 3 is obtained by curling 4 (preferably performed along 360° of the edge 3).

As already mentioned, the curling is an operation aimed at finishing of the edge, and is performed by means of the following steps:

positioning the capsule 1 inside a fixed contact element 20 and equipped with a seat 23, with the circular part 2 facing towards the same and introduced in the seat 23;

retaining the capsule 1 in position by an inner contact element 21 introduced in the seat 23 and in the edge 3;

axially moving a sliding tubular contact element 22 along the inner contact element 21 towards the fixed contact element 20 for following a peripheral area of the edge 3 causing a rounding or folding 4.

It should be noted that, preferably, the sliding tubular contact element 22 is moved at high speed, so as to strike the edge 3.

Figure 5:
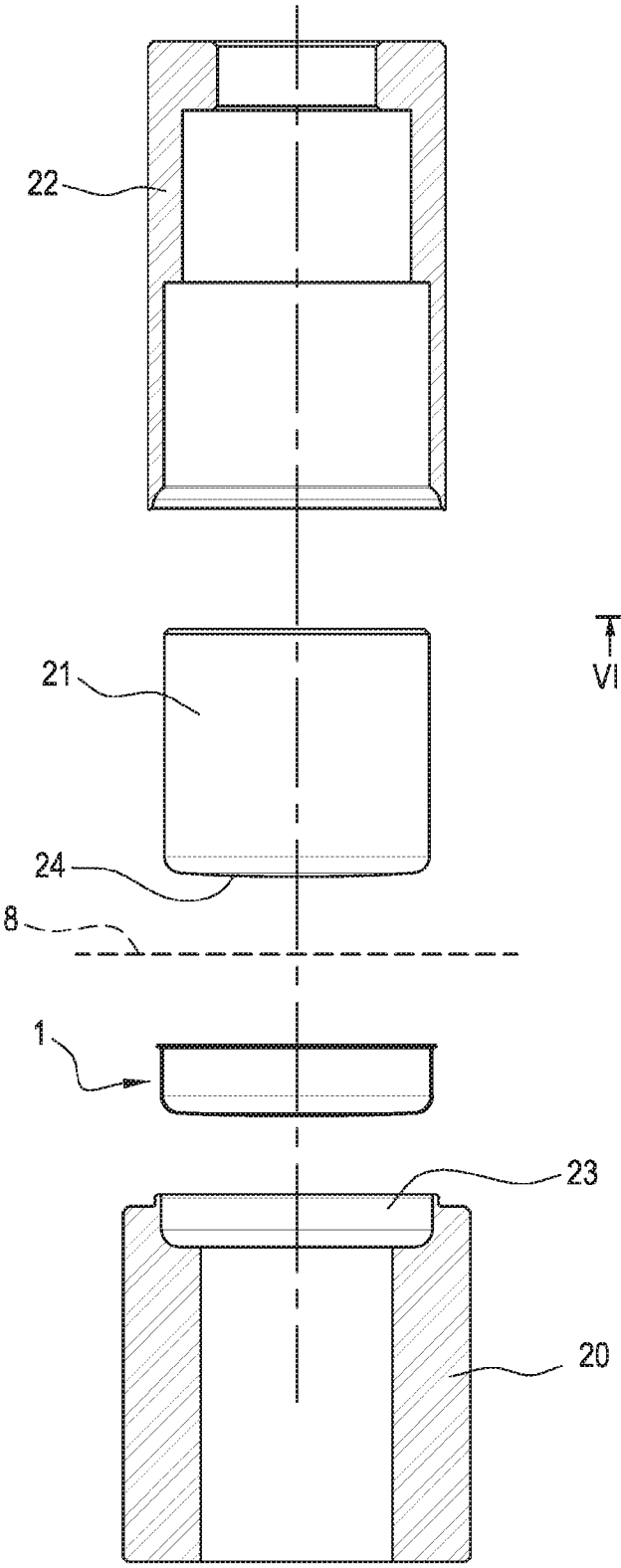
FIG. 5 illustrates the implementing means of FIG. 4, detached from each other.
Figure 7:
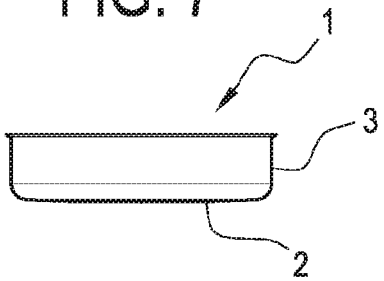
FIGS. 6, 7 and 8 illustrate, respectively, a top view of the cap according to the invention in an intermediate step, the cap along the section line VII-VII of FIG. 6 and the cap finished and ready to be applied to a bottle.
Figure 6:
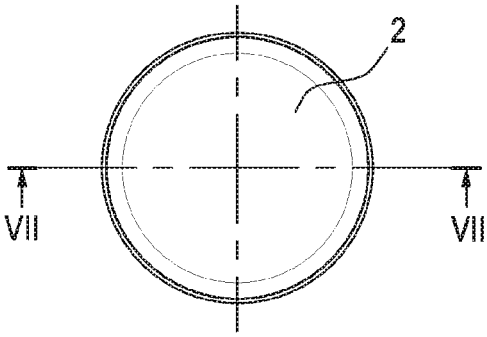

According to another aspect of the invention, in addition to the basic steps of the method, there is advantageously the making of the capsule 1 by positioning a disc of metallic material 8, for example steel, between the fixed contact element 20 and the inner contact element 21, which has its lower part 24 suitably shaped (FIG. 5).

The disc 8 is obtained from a sheet of metallic material, for example steel, as is usually used.

Patterns, consisting of a logo and/or wording may optionally be printed or marked on the sheet, which will then constitute a personalising element 7. The inner contact element 21 is then transferred with subsequent introduction of its shaped part 24 inside the fixed contact element 20. The consequent deformation of the disc 8 results in the formation of the edge 3.

This is followed by the actuation (axial movement) of the sliding tubular contact element 22 and implementation of the curling.

With this shape, the cap is ready for use and is marketed.

The advantage is that of producing the cap with a single operation and with a single tool, in two steps: firstly the preparation of the capsule 1, and then the implementation of the curling.

For completion of the closure, after applying the capsule on the opening 10 a series of deformation areas 5 made in a radial direction R towards the centre of the capsule 1 is made on the edge 3, which extends in the direction at right angles or practically at right angles to the circular part 2.

The making of the deformation areas 5 may be actuated by an automatic device (not illustrated) applied along a bottling line, or by means of manually operated devices (not illustrated) for use on a limited quantity of bottles or containers, such as for the conventional caps.

What is needed is the creation of a pressure below the swelling 12 of the opening 10 to obtain a pulling action on the circular part 2 against the opening 10 and forming the sealing, thanks to the seal.

As already mentioned, it is possible to produce a number of deformation areas 5 in a radial fashion R of between 6 and 14, more preferably between 8 and 12, optimally equal to 10.

Figure 2:
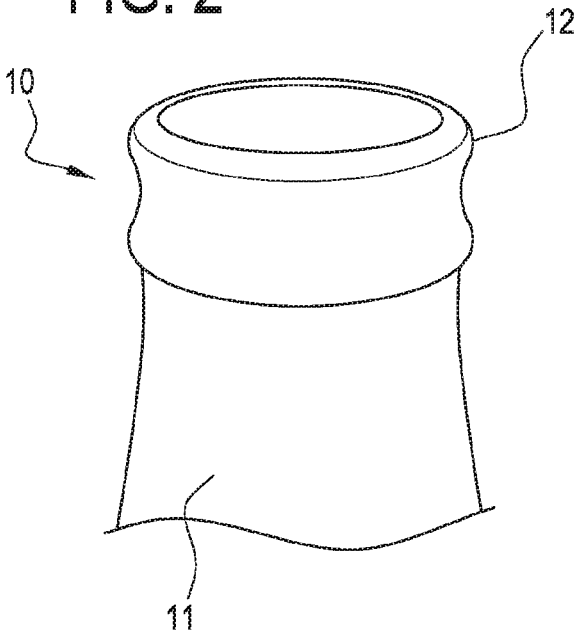
FIG. 2 illustrates a perspective view of the upper part of a bottle, comprising the opening which must be closed by the cap
Figure 3:
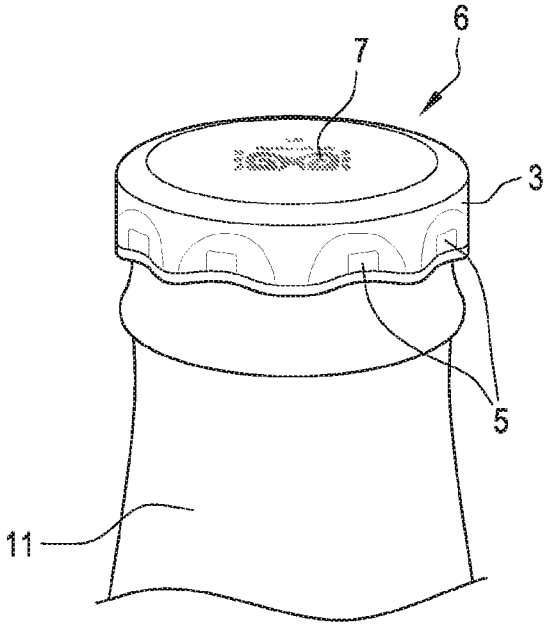
FIG. 3 illustrates, again according to a perspective view, the upper part of the bottle closed with a cap obtained and applied according to the invention.

Another aspect of the invention is a method for the capping of a container 11, or bottle, by means of a metallic closure which, starting from a capsule 1 made according to the method described above, comprises:

preparing a container 11, in particular a bottle, having an opening 10 having a swelling 12 protruding towards the outside along its entire extension (FIG. 2);

applying the capsule 1 with the circular part 2 resting on the opening 10 and the edge 3 positioned around the protruding swelling 12;

pressing the circular part 2 against the opening 10;

radial deformation R at a predetermined number of areas of the edge 3 towards the centre of the capsule 1 whilst maintaining the pressure of the circular part 2 against the opening 10 (FIG. 3).

Figure 4:
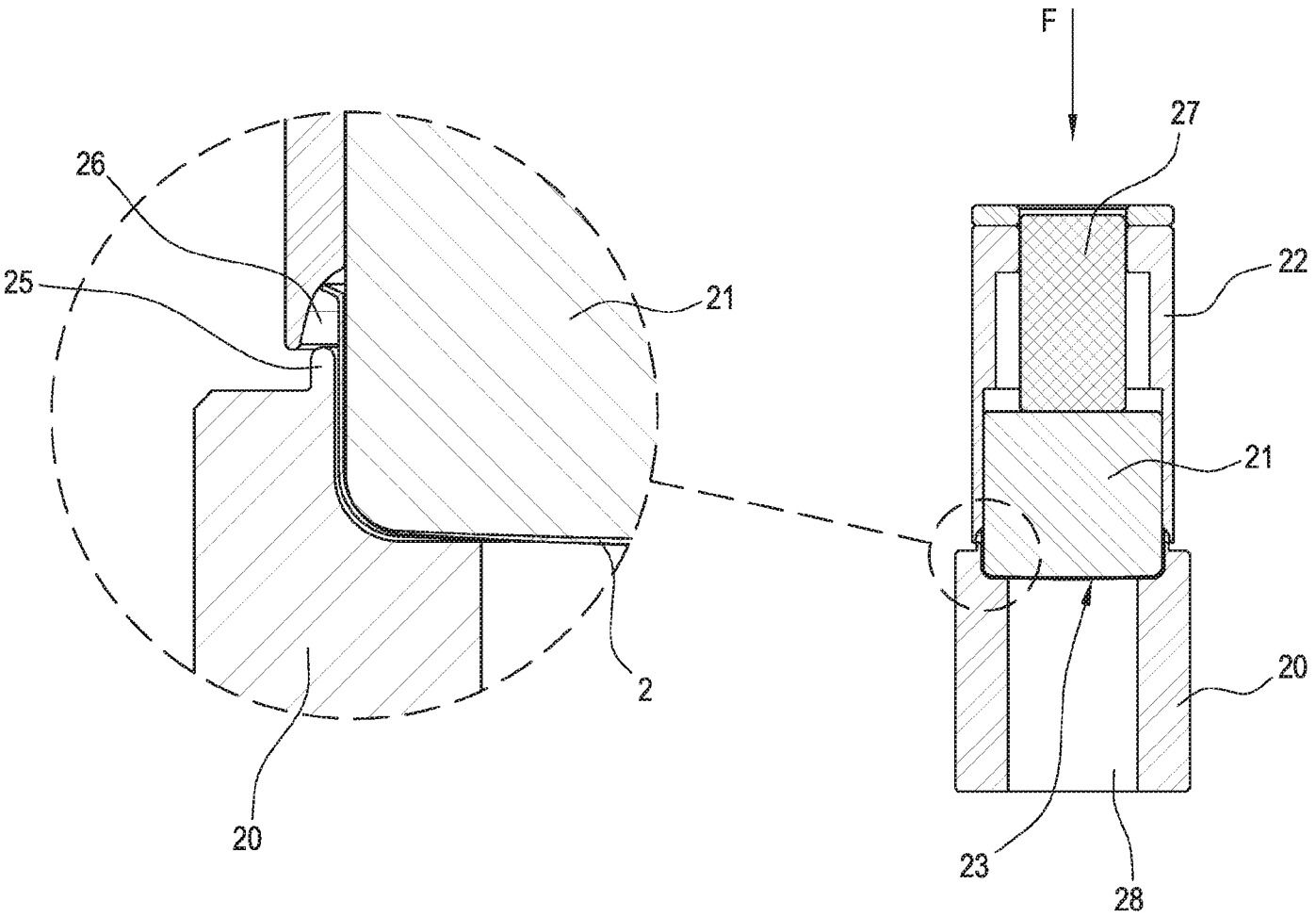
FIG. 4 illustrates the means for implementing the method according to the invention and for producing the cap with an enlarged view of a detail.

According to another aspect of the invention, with reference to FIGS. 4 and 5, the means for making a metallic closure for containers, in particular bottles, comprising a capsule 1 with a circular part 2 and the perimeter edge 3 intended to wrap circumferentially around the opening 10, comprise:

a fixed contact element 20, with a seat 23 made at its top;

an inner contact element 21 with a part 24 shaped in a cylindrical fashion and complementary relative to the seat 23, which is movable to be introduced axially in the seat 23 for giving the shape of a capsule 1 to a disc of metallic material 8 positioned between the fixed contact element 20 and the inner contact element 21, as well as to retain the capsule 1 in position;

a tubular contact element sliding along the inner contact element 21 towards the fixed contact element 20 for following a peripheral area of an edge 3 of the capsule 1, causing a rounding or folding 4.

More specifically, as shown in the enlarged detail of FIG. 4, the upper edge of the fixed contact element 20 has a projection 25, which extends upwards, on the innermost side, whilst the lower edge of the movable contact element 22 has a chamfering 26 which is at the projection 25.

The contact between the projection 25 with the chamfering 26 (between which the edge 3 is interposed) determines the rounding or folding 4 of the side of the edge 3 along the entire circumference.

The movement of the inner contact element 21 is obtained by means of the thrust of a punch 27 which is introduced in the opening of the upper part of the movable contact element 22 by pushing it towards the fixed contact element 20 (arrow F in FIG. 4).

Advantageously, the fixed contact element 20 may have a tubular shape (FIGS. 4 and 5) and the seat 23 is obtained by a widening of the inner diameter of the fixed contact element 20. This allows, if necessary, to introduce from the bottom of the fixed contact element 20 means (not illustrated) for extraction of the capsule 1 from the seat 23.

The invention claimed is:

1. A metal closure for a container, comprising:

a capsule defining a body of the metal closure, configured to be applied to cover an opening of the container for closing the container, the capsule comprising a circular part from which extends a perimeter edge configured to wrap circumferentially around the opening, to form a seal of the capsule relative to the container, wherein the perimeter edge has a rounding or folding obtained by curling, the rounding or folding having a double layer of material of the perimeter edge at an end portion of the perimeter edge distal from the circular part, wherein the perimeter edge extends at right angles or substantially right angles to the circular part and includes a series of deformations made in a radial direction towards a center of the capsule and configured to engage the container and apply a pressure to the container below a swelling of the opening to obtain a pulling action of the circular part against the opening and form a seal, the deformations being made in predetermined areas of the perimeter edge spaced apart from the rounding or folding toward the circular part;

wherein a distance between a start of the rounding or folding, which constitutes the end portion of the perimeter edge, and an inner surface of the circular part, is greater than 4 mm;

wherein the capsule is made of a metallic material having a thickness between 0.12 mm and 0.16 mm;

wherein a quantity of the deformations is between 6 and 14;

wherein an entirety of the circular part is smooth and flat;

wherein the perimeter edge has a smooth and continuous cylindrical profile extending 360° around the circular part;

wherein the smooth and continuous cylindrical profile merges with the circular part in a smooth radius extending 360° around the circular part;

wherein the smooth and continuous cylindrical profile entirely extends from the smooth radius to a position matching a lower portion of the swelling of the opening.

2. The metal closure according to claim 1, wherein the rounding or folding extends around 360° of the perimeter edge.

3. The metal closure according to claim 1, substantially constituting a bottle cap.

4. The metal closure according to claim 1, wherein an upper surface of the circular part contains a personalizing element.

5. A method for making a metal closure for a container having a circular opening which has a swelling, comprising the following steps:

making a capsule defining a body of the metal closure, configured to be applied to cover the opening of the container for closing the container, the capsule comprising a circular part, configured to rest over the opening, and a perimeter edge extending from the circular part and configured to wrap circumferentially around the opening, to form a seal of the capsule relative to the container;

making a rounding or folding of the perimeter edge by curling the perimeter edge, the rounding or folding having a double layer of material of the perimeter edge at an end portion of the perimeter edge distal from the circular part;

providing that the perimeter edge extends at right angles or substantially right angles to the circular part and includes a series of deformations made in a radial direction towards a center of the capsule and configured to engage the container and apply a pressure to the container below a swelling of the opening to obtain a pulling action of the circular part against the opening and form a seal, the deformations being made in predetermined areas of the perimeter edge spaced apart from the rounding or folding toward the circular part;

providing that a distance between a start of the rounding or folding, which constitutes the end portion of the perimeter edge, and an inner surface of the circular part, is greater than 4 mm;

providing that the capsule is made of a metallic material having a thickness between 0.12 mm and 0.16 mm;

providing that a quantity of the deformations is between 6 and 14;

providing that:

an entirety of the circular part is smooth and flat;

the perimeter edge has a smooth and continuous cylindrical profile extending 360° around the circular part;

the smooth and continuous cylindrical profile merges with the circular part in a smooth radius extending 360° around the circular part;

the smooth and continuous cylindrical profile entirely extends from the smooth radius to a position matching a lower portion of the swelling of the opening.

6. The method according to claim 5, wherein the step of making the rounding or folding of the perimeter edge by curling comprises performing the curling along 360° of the perimeter edge.

7. The method according to claim 5, wherein the curling is performed by the following steps:

positioning the capsule inside a fixed contact element equipped with a seat, with the circular part facing towards the seat and introduced in the seat;

retaining the capsule in position with an inner contact element introduced in the perimeter edge;

moving a sliding tubular contact element along the inner contact element towards the fixed contact element for following a peripheral area of the perimeter edge to cause the rounding or folding.

8. The method according to claim 5, also comprising:

making the capsule by preparing a metallic disc between a fixed contact element and an inner contact element and introducing the inner contact element inside the fixed contact element with deformation of the disc and formation of the perimeter edge;

retaining the capsule in position by the inner contact element introduced inside the perimeter edge;

axially moving a sliding tubular contact element along the inner contact element towards the fixed contact element for following a peripheral area of the perimeter edge to cause the rounding or folding.

9. The method according to claim 5, also comprising making a personalizing element on an upper part of the circular part.

10. A method for capping a container equipped with a circular opening which has a swelling towards an exterior with a circumferential extension, comprising:

providing the metal closure made using the method according to claim 6;

providing the container having the opening and the swelling protruding towards the exterior along an entire extension of the swelling;

applying the capsule with the circular part resting on the opening and the perimeter edge positioned around the protruding swelling;

pressing the circular part against the opening.

11. The method according to claim 10, wherein after applying the capsule on the opening with the perimeter edge positioned around the protruding swelling, radially deforming the perimeter edge at right angles or substantially at right angles to the circular part, to form the deformations, to apply the pressure below the swelling of the opening to obtain the pulling action of the circular part against the opening and form the seal.

* * * * *